US009230766B2

(12) United States Patent
Hrncir, Jr. et al.

(10) Patent No.: US 9,230,766 B2
(45) Date of Patent: Jan. 5, 2016

(54) BREAKER SECONDARY TERMINAL BLOCK ISOLATION CHAMBER

(71) Applicant: EATON CORPORATION, Cleveland, OH (US)

(72) Inventors: Daniel Edward Hrncir, Jr., Fletcher, NC (US); David Aaron Metcalf, Black Mountain, NC (US)

(73) Assignee: EATON COPORATION, Cleveland, OH (US)

( * ) Notice: Subject to any disclaimer, the term of this patent is extended or adjusted under 35 U.S.C. 154(b) by 152 days.

(21) Appl. No.: 13/937,441

(22) Filed: Jul. 9, 2013

(65) Prior Publication Data

US 2015/0016084 A1 Jan. 15, 2015

(51) Int. Cl.
*H01H 71/08* (2006.01)

(52) U.S. Cl.
CPC ..... *H01H 71/08* (2013.01); *H01H 2071/086* (2013.01); *Y10T 29/49002* (2015.01)

(58) Field of Classification Search
CPC ..... H04Q 1/142; H04Q 1/14; H04Q 1/141; H01H 71/08; H01R 9/24; H01M 2/34; H01M 2/348; H01M 10/42; H01M 2/0408; Y02E 60/12
See application file for complete search history.

(56) References Cited

U.S. PATENT DOCUMENTS 4,603,376 A * 7/1986 Maier ..... 361/824
4,928,080 A * 5/1990 Jacobs et al. ..... 335/202
5,811,749 A * 9/1998 Bausch et al. ..... 218/157
6,152,758 A * 11/2000 Matsuoka ..... H01R 13/6215 439/247
6,172,586 B1 * 1/2001 Ferree et al. ..... 335/202
6,211,759 B1 * 4/2001 Little et al. ..... 335/202
6,379,196 B1 * 4/2002 Greenberg et al. ..... 439/801
6,404,652 B1 * 6/2002 Takebayashi ..... H01R 9/2408 361/824
6,447,307 B1 * 9/2002 Wu ..... H01R 12/724 429/79
6,452,813 B1 * 9/2002 Gretz ..... 361/826
6,736,650 B1 * 5/2004 Chen ..... H01R 13/4368 439/713
6,930,577 B2 * 8/2005 Subramanian et al. ..... 335/202
7,009,126 B2 * 3/2006 Etscheidt et al. ..... 200/293
7,554,781 B1 * 6/2009 Weeks et al. ..... 361/42
7,633,363 B2 * 12/2009 Fausch ..... 335/129
8,123,533 B2 * 2/2012 Luo ..... H01R 12/712 439/567
8,169,283 B2 * 5/2012 Siebels et al. ..... 335/202
8,366,492 B2 * 2/2013 Erickson et al. ..... 439/709
8,698,023 B2 * 4/2014 Grunwald ..... 200/304
8,853,576 B2 * 10/2014 Sisley et al. ..... 200/304
8,859,918 B2 * 10/2014 Sisley et al. ..... 200/293
2002/0144978 A1 * 10/2002 Leone et al. ..... 218/154

(Continued)

*Primary Examiner* — Hoa C Nguyen
*Assistant Examiner* — Xanthia C Cunningham
(74) *Attorney, Agent, or Firm* — Eckert Seamans Cherin & Mellot, LLC; Carol A. Marmo; Philip E. Levy

(57) ABSTRACT

The disclosed concept pertains generally to secondary terminal blocks and, more particularly, to apparatus and methods for isolating the secondary terminal blocks and associated wiring in electrical switching assembly enclosures. The apparatus includes a housing having an outer surface structured to form a cavity therein. The apparatus is positioned in an enclosure which includes an electrical switching apparatus and one or more secondary terminal blocks. The one or more secondary terminal blocks are positioned in the cavity such that the apparatus at least substantially isolates the one or more secondary terminal blocks from the electrical switching apparatus. Further, the apparatus is effective to substantially isolate the secondary terminal blocks from temperature and pressure effects resulting from an arcing fault occurring in the enclosure.

14 Claims, 2 Drawing Sheets

(56) References Cited

U.S. PATENT DOCUMENTS

2005/0094357 A1* 5/2005 Ewing ..... H01H 85/0241 361/626
2007/0151078 A1* 7/2007 Kim et al. ..... 16/325
2008/0074217 A1* 3/2008 Duchrow et al. ..... 335/202
2008/0246566 A1* 10/2008 Oh ..... 335/197
2009/0257174 A1* 10/2009 Rane ..... H01H 71/08 361/673
2012/0133224 A1* 5/2012 Grosskopf et al. ..... 310/71
2012/0188668 A1* 7/2012 Weeks et al. ..... 361/42
2013/0207494 A1* 8/2013 Patel et al. ..... 310/71
2013/0278361 A1* 10/2013 Weeks et al. ..... 335/6

* cited by examiner

10

BREAKER SECONDARY TERMINAL BLOCK ISOLATION CHAMBER

BACKGROUND

1. Field

The disclosed concept pertains generally to secondary terminal blocks and, more particularly, the disclosed concept pertains to apparatus and methods for isolating the secondary terminal blocks and associated wiring in electrical switching assembly enclosures.

2. Background Information

Electrical switching assemblies are generally well known in the art and include, for example, circuit switching devices and circuit interrupters, such as circuit breakers, contactors, motor starters, motor controllers and other load controllers. Circuit breakers are used for protecting electrical circuitry from damage due to an over current condition, such as an overload condition or a relatively high level short circuit or fault condition. Molded case circuit breakers, for example, include at least one pair of separable contacts which are operated either manually by way of a handle disposed on the outside of the case or automatically by way of an internal trip unit in response to an over current condition. In the automatic mode of operation, an electronic trip unit, for example, controls an operating mechanism that opens the separable contacts. In the manual mode of operation, the handle cooperates with the operating mechanism in order to open the separable contacts. Circuit breakers have at least one line terminal for connection to a power source and at least one load terminal for connection to a load, such as a motor. The separable contacts of the circuit breakers are internally connected to the line and load terminals. Circuit breakers may also have one or more auxiliary terminals. Such auxiliary terminals may be utilized as inputs to provide an external signal for tripping the circuit breaker. Furthermore, other such auxiliary terminals may be utilized as outputs to externally indicate the trip status of the circuit breaker.

Typically, electrical switching assemblies, e.g., circuit breakers, are contained within enclosures. The enclosures are effective to protect the electrical switching assemblies from exposure to environmental conditions. The enclosures typically include at least one circuit breaker, internal components and a terminal block positioned therein. Terminal blocks are generally known electrical connector devices which are employed for joining two or more wires to a single connection point. Terminal blocks include a plurality on input connections and a plurality of output connections for receiving a plurality of control wires. Terminal blocks are used to electrically connect or interface components of an electrical system or electrical components within a mechanical system. Terminal blocks can be used to connect control wiring among various items of equipment within an enclosure or to make connections among individually enclosed items. The terminal blocks are structurally coupled to a surface of the enclosure by using a snap-in or screw-mounted mechanism. In conventional electrical switching apparatus, one or more first terminal blocks can be used to support first components and one or more secondary terminal blocks can be used to support secondary components in secondary control circuits.

Terminal blocks are generally not very well protected from contact with personnel or foreign conducting materials. In conventional circuit breaker enclosures, the secondary terminal blocks are not isolated from the breaker compartment. As a result, the secondary terminal blocks may not be capable to withstand the temperature and pressure effects of an electrical arcing fault which occurs in the breaker compartment.

Accordingly, there is room for improvement in known electrical switching assembly, such as circuit breaker, enclosures which contain secondary terminal blocks. It is desired that a compartment, e.g., isolation chamber, be designed and developed to enclose or house the secondary terminal blocks and associated wiring. This isolation chamber would be capable of isolating the secondary terminal block area from other components of the circuit breaker enclosure and, to withstand the temperature and pressure effects of an electrical arcing fault which may occur in the breaker compartment. It is further desired that the isolation chamber be adaptable to accommodate various switchgear and breaker configurations and sizes. Moreover, it is desired that the isolation chamber enhance the current arc resistant low voltage switchgear assembly by allowing personnel access to the secondary terminal blocks while maintaining the arc resistant rating.

SUMMARY

These needs and others are met by embodiments of the disclosed concept.

In accordance with one aspect of the disclosed concept, there is provided an apparatus including a housing. The housing includes an outer surface structured to form a cavity therein and at least one slot formed through the outer surface, the at least one slot is structured to receive a plurality of connecting wires. The apparatus is positioned in an enclosure which comprises an electrical switching apparatus and one or more secondary terminal blocks. The one or more secondary terminal blocks are positioned in the cavity such that the apparatus at least substantially isolates the one or more secondary terminal blocks from the electrical switching apparatus.

In certain embodiments, the housing can include a rectangular member having an a top side, bottom side, back side and pair of opposing end walls, and at least one adjustable slot formed in at least one of the pair of opposing end walls.

In accordance with another aspect of the disclosed concept, there is provided a method for at least substantially isolating one or more secondary terminal blocks from an electrical switching apparatus in an enclosure. The method includes installing an apparatus in the enclosure which is structured to house the one or more secondary terminal blocks. The apparatus includes an outer surface structured to form a cavity therein; and at least one slot structured to receive a plurality of wires. The method further includes positioning the one or more secondary terminal blocks within the cavity.

In certain embodiments, the apparatus and method are effective to substantially isolate the one or more secondary terminal blocks from high temperature and pressure conditions, e.g., gases released into the enclosure as a result of an arc fault occurring in the enclosure.

In accordance with another aspect of the disclosed concept, there is an electrical switching apparatus enclosure including a molded case having walls forming a cavity including an outer wall and an inner wall, an electrical switching mechanism contained in the cavity, one or more secondary terminal blocks, and a chamber to house and isolate the one or more secondary terminal blocks. The chamber including a mounting means to couple the chamber to the inner wall of the molded case.

BRIEF DESCRIPTION OF THE DRAWINGS

A full understanding of the disclosed concept can be gained from the following description of the preferred embodiments When read in conjunction with the accompanying drawings in which.

DESCRIPTION OF THE PREFERRED EMBODIMENTS

Figure 1:
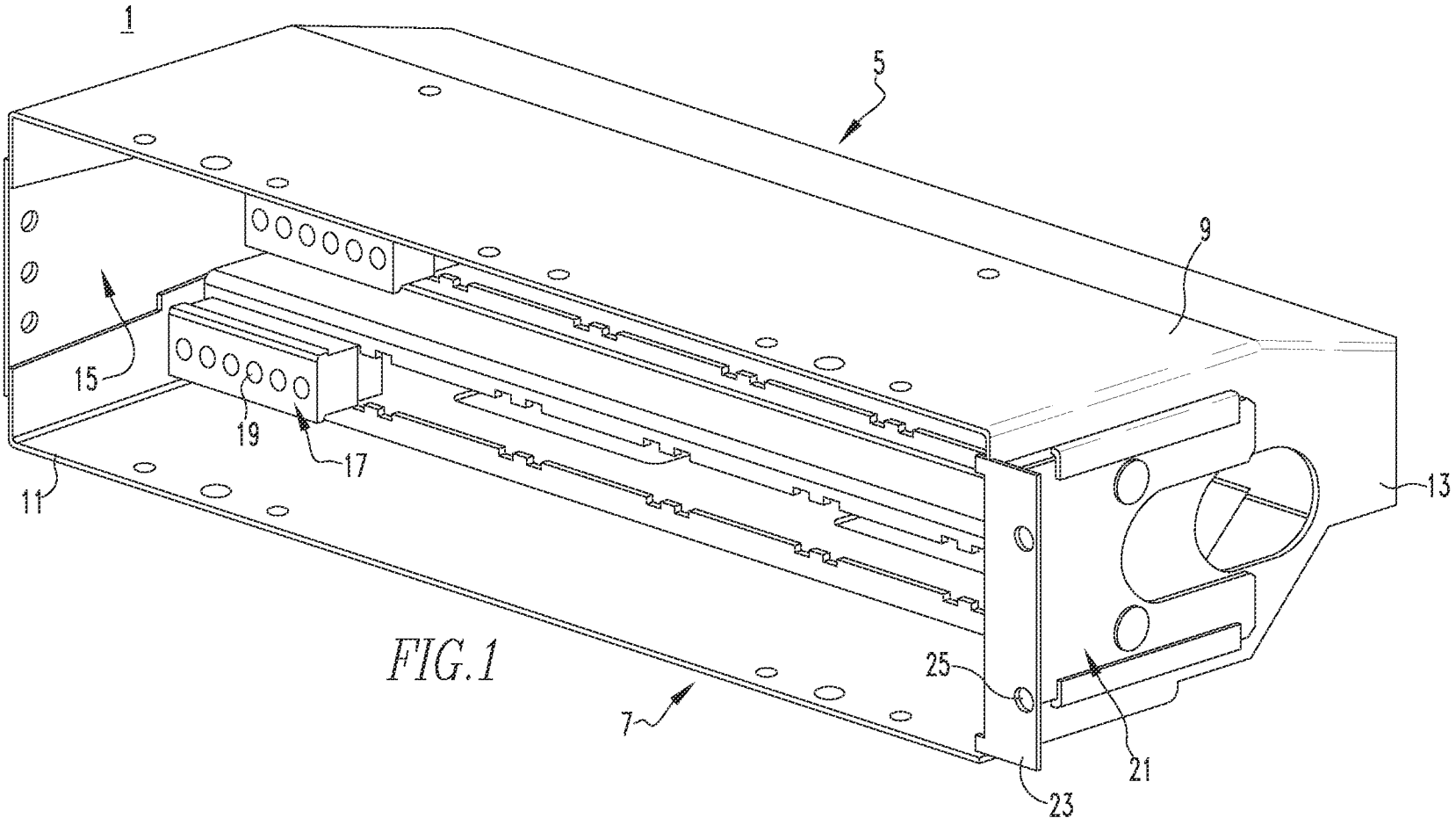
FIG. 1 is a perspective view of an isolation apparatus to house secondary terminal blocks in a circuit breaker enclosure, in accordance with certain embodiments of the invention.

Direction phrases used herein, such as, for example and without limitation, top, bottom, left, right, upper, lower, front, back and derivatives thereof, relate to the orientation of the elements shown in the drawings and are not limiting upon the claims unless expressly recited therein.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The disclosed concept is described in association with electrical switching apparatus, such as circuit breakers, although it will become apparent that the disclosed concept could also be applied to other types of electrical switching apparatus, e.g., without limitation, other circuit switching devices and other circuit interrupters such as contactors, motor starters, motor controllers and other load controllers.

In certain embodiments, the disclosed concept includes an apparatus, e.g., chamber or compartment, for housing and/or isolating one or more secondary terminal blocks in electrical switching apparatus, such as circuit breaker, enclosures. Secondary terminal blocks are generally not isolated from other components and wiring in a typical circuit breaker enclosure.

In certain other embodiments, the disclosed concept further includes a method of installing or incorporating an apparatus, e.g., chamber or compartment, into an electrical switching apparatus enclosure. One or more secondary terminal blocks and their associated wiring are positioned within the apparatus to isolate the one or more secondary terminal blocks from other components and wiring located in the electrical switching apparatus enclosure.

In general the apparatus of the invention includes a chamber or compartment for housing one or more secondary terminal blocks. The chamber or compartment has an opening to provide access to the secondary terminal blocks. The secondary terminal blocks include connection apertures formed therein. Each of the connection apertures is structured to receive an end of a connection wire. Thus, the chamber or compartment can also at least partially house one or more connection wires. Further, the chamber or compartment includes at least one adjustable slot to allow one or more connection wires to be received into the chamber or compartment from outside thereof The chamber or compartment is positioned in an enclosure which houses an electrical switching apparatus. The chamber or compartment isolates the secondary terminal blocks from the electrical switching apparatus and from other components that may be positioned in the electrical switching apparatus enclosure. In the event of an arcing fault occurring in the electrical switching apparatus enclosure, the chamber or compartment isolates the secondary terminal blocks from high temperature and pressure gas that typically results from the arcing fault. The chamber or compartment can also prevent the gas from exiting the electrical switching apparatus enclosure and being dissipated into the external atmosphere or environment.

FIG. 1 is an isometric view of an isolation chamber 1 in accordance with certain embodiments of the disclosed concept. The isolation chamber 1 includes a housing in the form of a rectangular member 5 having generally a trough shape which is open at a front side 7 and closed at a top side 9, bottom side 11, back side 13 (opposite to the front side 7) and a pair of opposing end walls 15, which define the rectangular member 5. The particular rectangular member 5 is not meant to be limiting and it should be understood that other types of housing members, e.g., having various shapes and sizes, may be substituted for the rectangular member 5. The particular housing member can depend on the size and configuration of the circuit breaker, the switchgear and/or the other components positioned in the circuit breaker enclosure.

The isolation chamber 1 of the disclosed concept can be constructed of a wide range of materials. Suitable materials may be selected from those materials that are known in the art for use in electrical switching assembly enclosure. The isolation chamber 1, in particular, the rectangular member 5, is typically made of a substantially rigid material. In certain embodiments, the isolation chamber 1 is at least partially constructed of a polymer and/or polymer-containing material. In particular, the isolation chamber 1 can be constructed of molded plastic. The isolation chamber can be prepared using conventional molding methods that are known in the art, such as but not limited to, injection molding.

As shown in FIG. 1, the front side 7 of the rectangular member 5 defines an opening which can function to provide access to the interior cavity defined by rectangular member 5.

Positioned within the rectangular member 5 is a pair of secondary terminal blocks 17. The two secondary terminal blocks 17 are shown in FIG. 1, however, it is contemplated that various designs and configurations of electrical switching apparatus may include one or more secondary terminal blocks 17. Each of the pair of secondary terminal blocks 17 includes a plurality of connection apertures 19. Each of the connection apertures 19 is adapted for receiving an end portion of a connection wire (not shown) and, electrically and mechanically engaging the end portion of the connection wire (not shown). An adjustable slot 21 is formed within each of the opposing end walls 15 of the rectangular member 5. Each of the adjustable slots 21 is adapted for receiving at least one connection wire (not shown), e.g., a wire harness, that is received by the plurality of apertures 19 formed in the pair of secondary terminal blocks 17. Further, as shown in FIG. 1, a vane 23 having a plurality of mounting apertures 25 formed therein is coupled to the rectangular member 5 to provide for connecting or attaching the isolation chamber 1 to a circuit breaker enclosure (shown in FIG. 2). One vane 23 is shown in FIG. 1, however, it is contemplated that various designs and configurations of electrical switching apparatus may include more than one vane 23 for mounting the isolation chamber 1 to the circuit breaker enclosure (shown in FIG. 2). Each of the mounting apertures 25 is adapted to receive an associated mounting mechanism, such as a screw or bolt (not shown). Although the vane 23 and the associated mounting mechanism (not shown) are used to couple or attach the isolation chamber 1 to the circuit breaker enclosure, e.g., interior wall, the disclosed concept contemplates using any suitable coupling and mounting mechanisms to accomplish this function.

The open front side 7 provides personnel the capability to access the secondary terminal blocks 17 and associated connection wires which are contained in the isolation chamber 1, e.g., rectangular member 5.

Figure 2:
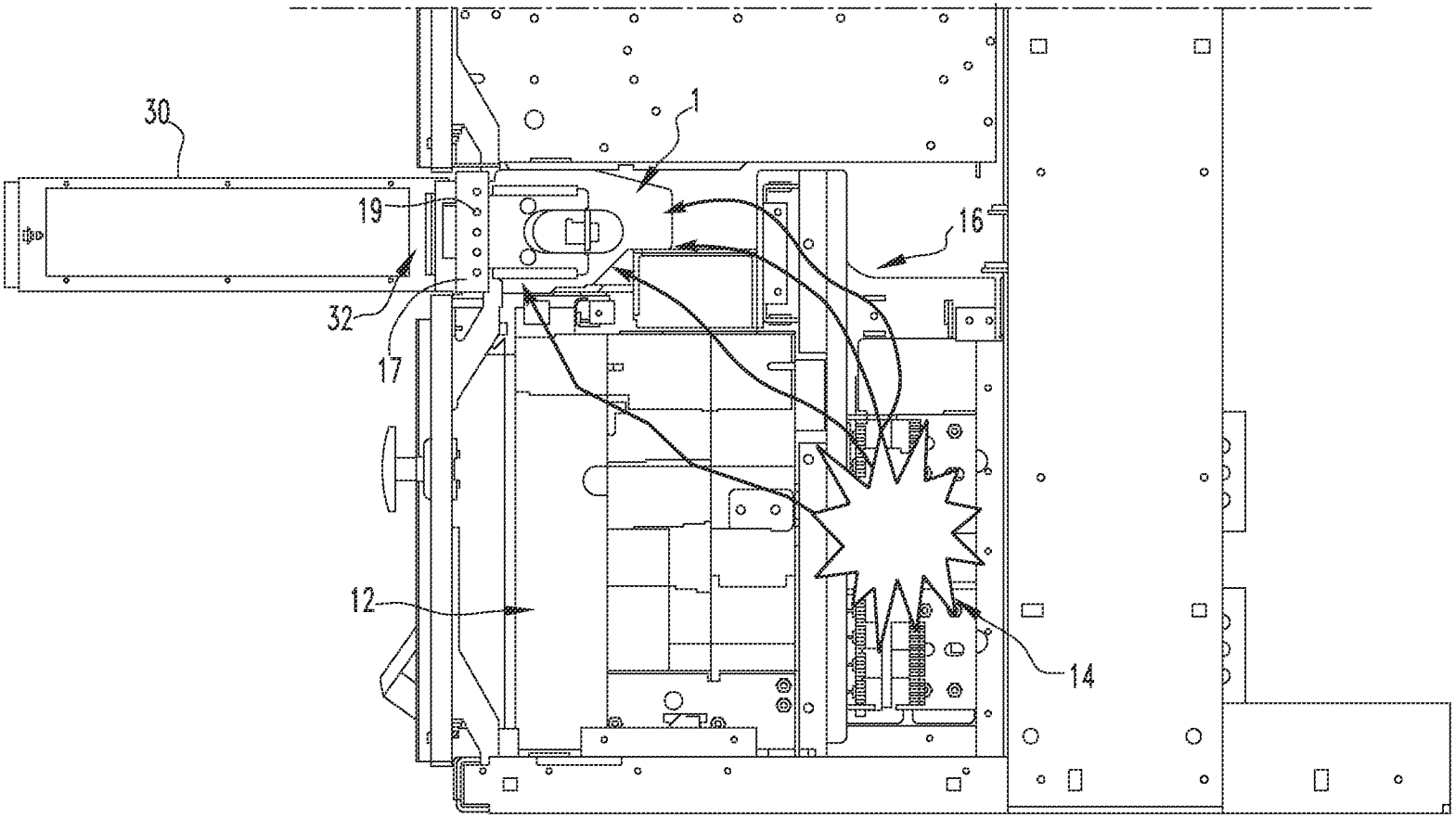
FIG. 2 is a side view of a circuit breaker enclosure including the isolation chamber of FIG. 1, in accordance with certain embodiments of the invention.

FIG. 2 is a side view of a circuit breaker enclosure 10 in accordance with certain embodiments of the disclosed concept. The circuit breaker enclosure 10 includes the isolation chamber 1 as shown in FIG. 1 including the rectangular member 5, one of the pair of secondary terminal blocks 17 and the connection apertures 19. FIG. 2 also includes a front portion 30, a personnel access point 32, a circuit breaker 12 and an arcing fault 14. The arcing fault produces increased, e.g., high, temperature and pressure gas 16. The circuit breaker enclosure 10 may house other components and equipment which are not shown in FIG. 2. As demonstrated in FIG. 2, the isolation chamber 1 is effective to house the secondary terminal blocks 17 and to at least substantially isolate the secondary terminal blocks 17 from the circuit breaker 12 and other components (not shown) which are positioned in the interior cavity or space of the enclosure 10. In the event of the arcing fault 14, the isolation chamber 1 is effective to isolate and protect the secondary terminal blocks 17 from the gas 16 which is released into the circuit breaker enclosure 10 as a result of the arcing fault 14. The gas 16 is prevented from entering the isolation chamber 1 and thereby prevented from escaping through the personnel access point 32 to the environment outside of the enclosure 10. Thus, access to the secondary terminal blocks 17 is provided while the arc resistant rating is maintained.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An apparatus, comprising:

a housing which comprises an outer surface structured to form a cavity therein;

at least one adjustable slot formed through the outer surface in the housing, the at least one adjustable slot structured to receive one or more connecting wires; and one or more secondary terminal blocks having one or more connection apertures formed therein and structured to receive an end of the one or more connecting wires, the one or more secondary terminal blocks positioned within the cavity, wherein said apparatus is positioned in an enclosure which comprises an electrical switching apparatus, and wherein the apparatus at least substantially isolates the one or more secondary terminal blocks and the one or more connecting wires from the electrical switching apparatus.

2. The apparatus of claim 1, wherein the apparatus is structured to substantially isolate the one or more secondary terminal blocks from temperature and pressure conditions released into the enclosure as a result of an arc fault occurring in the enclosure.

3. The apparatus of claim 2, wherein said conditions comprise high temperature and pressure gas.

4. The apparatus of claim 1, comprising:

a rectangular member having a front side opening, a top side, bottom side, back side, and a pair of opposing end walls; and at least one adjustable slot formed in at least one of the pair of opposing end walls.

5. The apparatus of claim 4, further comprising:

at least one vane for mounting the apparatus to a wall of the enclosure.

6. The apparatus of claim 1, wherein the apparatus is constructed of a material selected from the group consisting of rigid and semi-rigid materials.

7. The apparatus of claim 6, wherein the apparatus is constructed of a molded plastic component.

8. The apparatus of claim 1, wherein the apparatus is effective to provide access to secondary terminal blocks while maintaining arc resistant rating.

9. The apparatus of claim 4, wherein the front side opening allows access to the one or more secondary terminal blocks positioned therein.

10. A method of at least substantially isolating one or more secondary terminal blocks and one or more connecting wires associated therewith from an electrical switching apparatus in an enclosure, comprising:

forming a housing, comprising:

an outer surface structured to form a cavity therein; and at least one adjustable slot formed through the outer surface and structured to receive the one or more connecting wires;

positioning the one or more secondary terminal blocks within the cavity, the one or more secondary terminal blocks having one or more connection apertures formed therein and structured to receive an end of the one or more connecting wires; and installing the housing in the enclosure of the electrical switching apparatus.

11. The method of claim 10, wherein the apparatus is effective to withstand increased temperature and pressure gas resulting from an electrical arcing fault occurring in the enclosure.

12. The method of claim 10, wherein the apparatus is effective to prevent the increased temperature and pressure gas from escaping the enclosure.

13. An electrical switching apparatus enclosure, comprising:

a molded case having walls forming a first cavity including an outer wall and an inner wall;

an electrical switching mechanism positioned within the first cavity of the molded case;

a chamber positioned within the first cavity of the molded case, said chamber comprising:

an outer surface structured to form a second cavity;

at least one adjustable slot formed through the outer surface of the chamber, the at least one adjustable slot structured to receive one or more connecting wires; and a mounting means to couple said chamber to the inner wall of the molded case; and one or more secondary terminal blocks positioned within the second cavity, having one or more connection apertures formed therein and structured to receive an end of the one or more connecting wires.

14. The electrical switching apparatus enclosure of claim 13, wherein said electrical switching mechanism is a circuit breaker.

* * * * *